United States Patent [19]

Fairweather

[11] Patent Number: 5,033,117

[45] Date of Patent: Jul. 23, 1991

[54] EXERCISE GARMENT

[76] Inventor: Phil F. Fairweather, 6924 La Cienega Blvd. #2, Los Angeles, Calif. 90302

[21] Appl. No.: 491,207

[22] Filed: Mar. 9, 1990

[51] Int. Cl.[5] ..... A41D 1/08; A63B 21/00

[52] U.S. Cl. ..... 2/69; 2/79; 2/94; 2/227; 2/247; 2/249; 2/250; 272/93; 272/119; 272/143

[58] Field of Search ..... 2/69, 67, 79, 81, 102, 2/115, 227, 247, 249, 250, 236, 2.1 R; D2/40, 36; 272/93, 119, 143

[56] References Cited

U.S. PATENT DOCUMENTS

| | | | |
|---|---|---|---|
| 87,107 | 2/1869 | Morse | D2/40 |
| 3,731,319 | 5/1973 | O'Neil | 2/2.1 R |
| 3,759,510 | 9/1973 | Jackson, Jr. | 272/119 |
| 4,065,814 | 1/1978 | Fox | 2/79 |
| 4,268,917 | 5/1981 | Massey | 2/102 |
| 4,303,239 | 12/1981 | Walsh | 272/119 |
| 4,344,620 | 8/1982 | Debski | 2/102 |
| 4,384,369 | 5/1983 | Prince | 2/79 |
| 4,407,497 | 10/1983 | Gracie | 2/67 |
| 4,602,387 | 7/1986 | Zakrzewski | 2/102 |
| 4,910,802 | 3/1990 | Malloy | 2/227 |

FOREIGN PATENT DOCUMENTS

| | | | |
|---|---|---|---|
| 218063 | 7/1967 | Sweden | 272/119 |

*Primary Examiner*—Werner H. Schroeder
*Assistant Examiner*—Gloria Hale
*Attorney, Agent, or Firm*—William J. Benman, Jr.

[57] ABSTRACT

A unitary full body exercise suit is disclosed. The invention is a one piece garment including a pair of shorts with two thigh portions for covering at least part of the thigh of a user integrally connected to an upper body portion which covers a substantial portion of the abdomen of the user. A set of pockets adapted to receive a weight are included, one on each thigh portion of the shorts.

In the more specific embodiment, the invention is constructed of synthetic rubber and further includes belt loops between the upper body portion and the lower body portion adapted to receive a belt therebetween. The belt loops are comprised of straps which further support the weights in the pockets. The straps are sewn into the suit. Look and loop type fasteners are provided at the top of each of the pockets. Shoulder straps are included on the upper body portion of the suit.

The suit of the present invention provides a full one piece exercise suit which employs easily removable weights located and supported for optimum physical exertion and safe operation.

4 Claims, 3 Drawing Sheets

EXERCISE GARMENT

BACKGROUND OF THE INVENTION

1. Field of the Invention

The present invention relates to exercise equipment. More specifically, the present invention relates to clothing garments and the like worn for exercise.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

2. Description of the Related Art

Exercise garments are well known in the art. The following U.S. Patents are exemplary of exercise garments. U.S. Pat. No. 3,759,510 issued Sept. 18, 1973 to Jackson, Jr.; U.S. Pat. No. 4,065,814 issued Jan. 3, 1978 to Fox; U.S. Pat. No. 4,180,261 issued Dec. 25, 1979 to Kolka; U.S. Pat. No. 4,303,239 issued Dec. 1, 1981 to Walsh Jr.; U.S. Pat. No. 4,407,497 issued Oct. 4, 1983 to Gracie.

Jackson, Jr. shows a composite exercise garment with a helmet, jacket, armlets, gloves, belt, shorts, thigh leggings, calf leggings and boots. However, the design of Jackson, Jr. is not a one piece body suit permitting easy access. Weights on the upper portion of the suit may cause undesirable strain on the lower back and pressure on the sciatic nerve. Weights below the knee may cause hyperextension of the knee. If these upper and lower components of the suit were eliminated, the weights mounted on the thighs would tend to slide toward the knee. When the shorts are attached to the jacket, the weights on the lower part of the suit place considerable stress on the fastener at the waist during exercise.

Gracie's garment suffers from the high placement shortcoming mentioned above while Kolka and Walsh show less than full suits. As less than full suits, these designs offer no thermal advantages for the upper body.

The one piece body suit of Fox provides resistance via elastic bands which extend the length of the body. This system is limited with respect to the amount of resistance or weight which may be used. In addition, the suit must be appropriately sized to achieve optimal resistance for each user. This tends to militate against mass production thereby adding to the cost of the suit. Further, the life of the elastic bands may be found to be too short for the demands of a typical user. Finally, the use of elastic bands is effective to work only a few muscles at best. In fact, the elastic bands tend to aid and not resist many important muscle groups such as the thigh and abdomen muscles. No provision is made for working the muscles of the arms.

Thus, there is a need in the art for a full one piece exercise suit which employs easily removable weights located and supported for optimum physical exertion and safe operation.

SUMMARY OF THE INVENTION

The need in the art is addressed by the exercise suit of the present invention, a unitary full body exercise suit. The suit of the present invention is a one piece garment including a pair of shorts with two thigh portions for covering at least part of the thigh of a user integrally connected to an upper body portion which covers a substantial portion of the abdomen of the user. A set of pockets adapted to receive a weight are included, one on each thigh portion of the shorts.

In the more specific embodiment, the suit is constructed of synthetic rubber and further includes belt loops between the upper body portion and the lower body portion adapted to receive a belt therebetween. The belt loops are comprised of straps which further support the weights in the pockets. The straps are sewn into the garment. Hook and loop type fasteners are provided at the top of each of the pockets. Shoulder straps are included on the upper body portion of the suit.

The invention provides a full one piece exercise suit which employs easily removable weights located and supported for optimum physical exertion and safe operation.

DESCRIPTION OF THE INVENTION

Illustrative embodiments and exemplary applications will now be described with reference to the accompanying drawings to disclose the advantageous teachings of the present invention.

Figure 1:
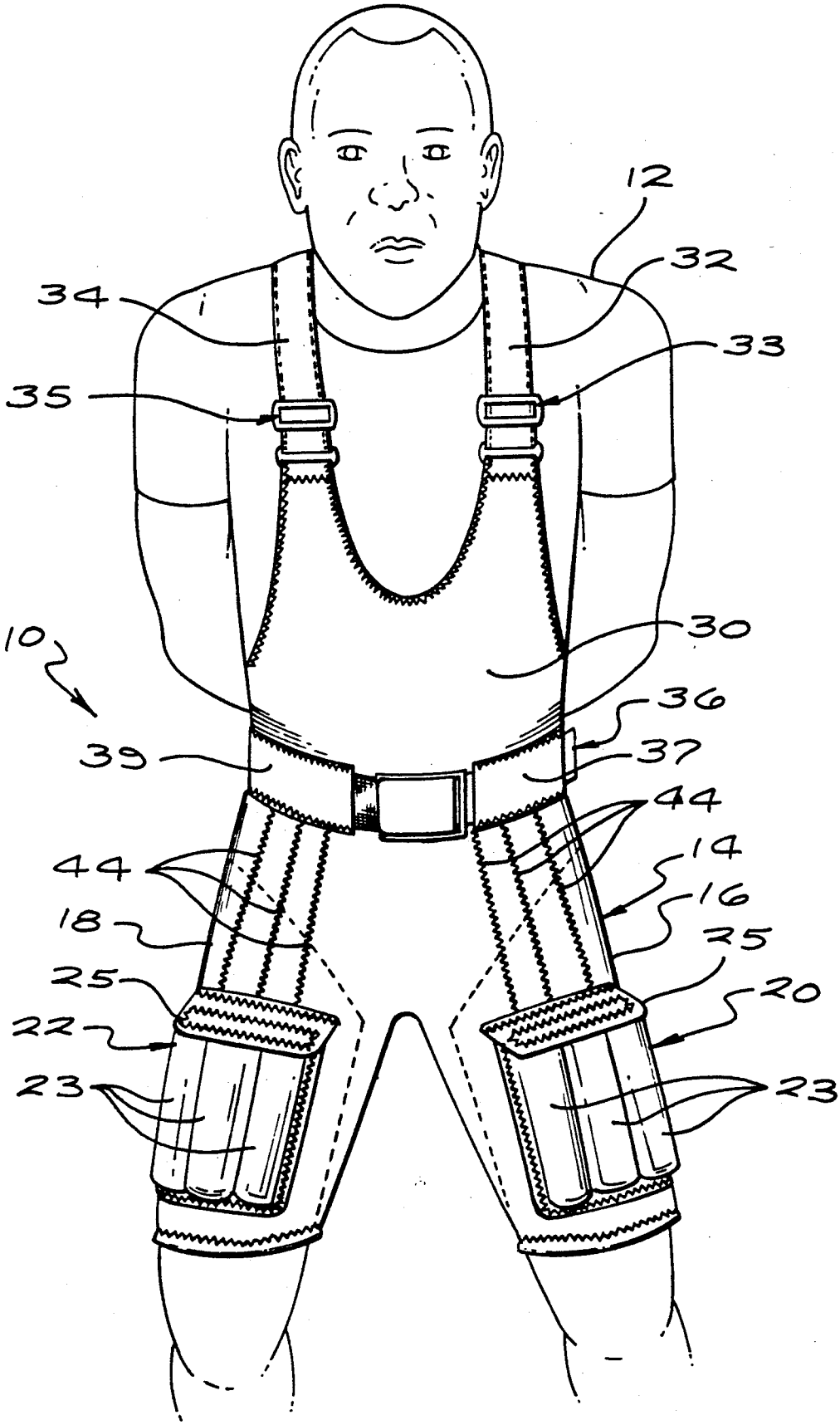
FIG. 1 is a frontal view in perspective of the exercise suit of the present invention shown on a user represented in phantom.
Figure 2:
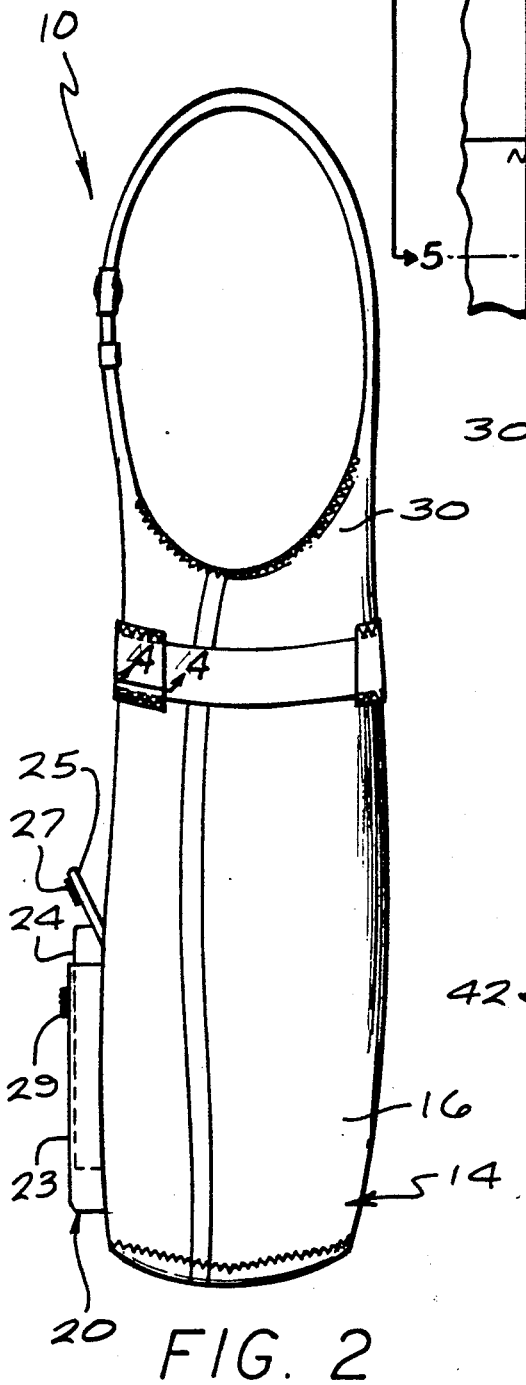
FIG. 2 is a sided elevational view of the exercise suit of the present invention.

FIG. 1 is a frontal view in perspective of the exercise suit 10 of the present invention shown on a user 12 represented in phantom. The suit 10 is a unitary full body exercise suit constructed, in the preferred embodiment, of Neoprene (synthetic rubber) or other comparable material, stitched or sewn together with a nylon thread. As is understood in the art, Neoprene includes an outer layer of lycra over a rubber base layer. The suit 10 includes a pair of shorts 14 with two thigh portions 16 and 18 for covering at least part of the thigh of a user 12. In the illustrative embodiment, a terrycloth lining (not shown) is provided in the shorts 14 to remove perspiration from the skin of the user 12. A set of pockets 20, 22 are included, one on each thigh portion 16 and 18, respectively, of the shorts 14. Each pocket is stitched on the front surface thereof to provide plural slots 23, each adapted to receive a weight 24 shown partially extending from the open pocket 20 in the elevational side view of FIG. 2. In FIG. 2, the flap 25 of the pocket 20 is shown as having a first section 27 of hook and loop type fastener stitched thereto. A second mating section 29 of hook and loop type fastening material is stitched to the body of the pocket. The hook and loop type fastener allows easy insertion and removal of the weights 24 and secures the weights 24 in the pockets during the use of the suit.

Figure 3:
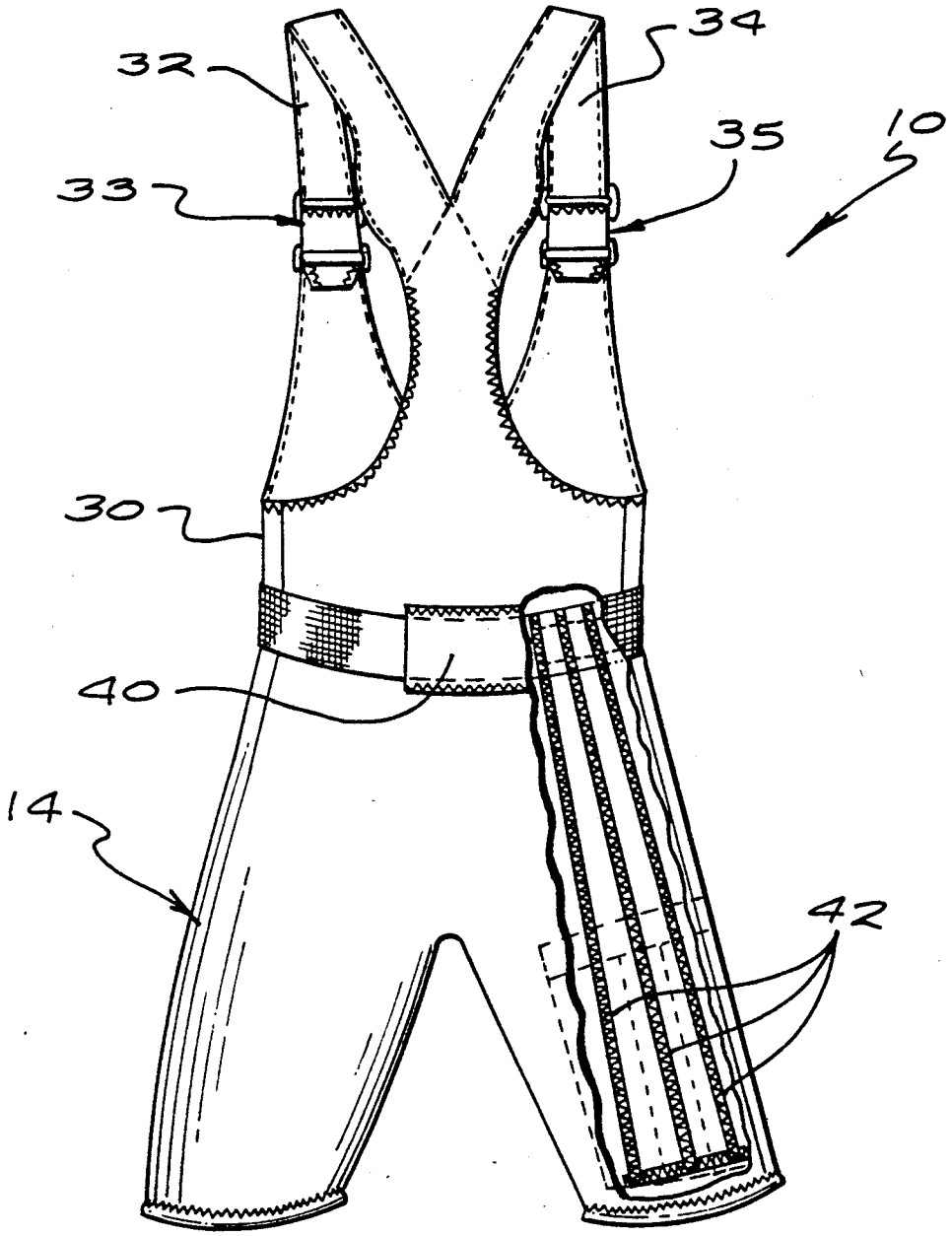
FIG. 3 is a rear view of the suit of the present invention in perspective with a partial cutout to show the rear of the front right thigh section thereof.

As illustrated in FIGS. 1 and 2, the shorts 14 are integrally connected to an upper body portion 30 which covers a substantial portion of the abdomen of the user 12. The user 12 applies the suit by stepping into the shorts 14 and pulling the upper portion of the suit 30 up over the shoulders. Straps 32 and 34 are brought up over the back and secured by conventional strap buckles 33 and 35 respectively. Finally, a belt 36 is tightened as desired about the waist of the suit 10 through first and second frontal belt loops 37 and 39 and a rear belt loop 40 as shown in the rear perspective view of FIG. 3.

Figure 4:
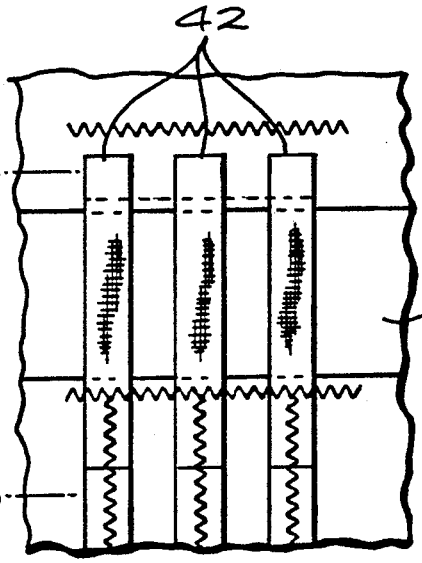
FIG. 4 is a sectional view showing the construction of the unique and advantageous belt loops of the exercise suit of the present invention.
Figure 5:
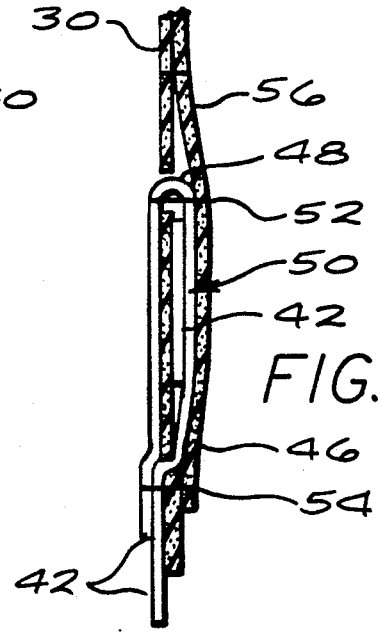
FIG. 5 is a sectional side view of the representation of a belt loop shown in FIG. 4.

In FIG. 2, a portion of the rear of the right thigh section 18 of the shorts 14 is cut away to reveal plural nylon straps 42 which are sewn into the rear surface of the frontal portions of the thigh sections 16 and 18 of the shorts 14 behind and under the pockets 20 and 22. The stitching 44 for these straps 42 is shown in FIG. 1. As best illustrated in FIGS. 4 and 5, the nylon straps 42 run the length of the thigh and loop around inside the frontal belt loops 37 and 39 so that the weights 24 in the pockets 20 and 22 are supported by the belt 36. FIG. 4 is a frontal view with the front portion of the belt loop 37 removed to show the straps 42. The belt loop 36 is shown in phantom. FIG. 5 is a sectional side view of the representation of the belt loop of FIG. 4. Each strap 42 extends up from the pocket along the back surface of the front portion of the thigh section of the suit. The straps 42 extend through slots 46 and 48 cut into the skin of the suit thereby forming a loop 50. Stitching 52 and 54 is provided at the top and bottom of the loop 50 to further secure the strap to the suit. A synthetic rubber flap 56 is provided over the loop 50 for esthetic purposes.

The invention provides a full one piece exercise suit which employs easily removable weights located and supported for optimum physical exertion and safe operation.

Thus, the present invention has been described herein with reference to a particular embodiment for a particular application. Those having ordinary skill in the art and access to the present teachings will recognize additional modifications applications and embodiments within the scope thereof.

It is therefore intended by the appended claims to cover any and all such applications, modifications and embodiments within the scope of the present invention.

Accordingly, what is claimed is:

1. A unitary full body exercise suit comprising:

a one piece suite including a pair of shorts with two thigh portions for covering at least part of the thigh of a user integrally connected to an upper body portion which covers a substantial portion of the abdomen of the user;

a set of pockets, one on each thigh portion of the shorts adapted to receive a weight;

belt loops between the upper body portion and the lower body portion adapted to receive a belt therebetween, said belt loops having straps sewn into the suit which further support said weights in said pockets.

2. The invention of claim 1 wherein said suit is constructed of Neoprene.

3. The invention of claim 2 including shoulder straps on the upper body portion of said suit.

4. The invention of claim 3 including Velcro brand fasteners at the top of each of said pockets.

* * * * *